US005453141A

United States Patent [19]

Rodriguez

[11] Patent Number: 5,453,141

[45] Date of Patent: Sep. 26, 1995

[54] TRANSFER TAPE AND METHOD FOR CUTTING AND SPOOLING A WEB OF PAPER

[76] Inventor: Peter A. Rodriguez, 1785 Selva Marina Dr., Atlantic Beach, Fla. 32233

[21] Appl. No.: 131,082

[22] Filed: Oct. 1, 1993

[51] Int. Cl.[6] ..... B65H 19/00

[52] U.S. Cl. ..... 156/184; 156/185; 156/187; 156/190; 156/193; 242/521; 242/526.2; 428/343

[58] Field of Search ..... 156/184, 185, 156/187, 190, 191, 192, 193, 446, 447; 242/521, 522, 526.2; 428/40, 41, 42, 343

[56] References Cited

U.S. PATENT DOCUMENTS

| | | | |
|---|---|---|---|
| 2,889,922 | 6/1959 | Clarvoe | 206/56 |
| 4,100,681 | 7/1978 | Hollander | 428/40 |
| 4,414,258 | 11/1983 | Corbin, Sr. | 242/526.2 X |
| 4,659,029 | 4/1987 | Rodriguez | 242/56 R |
| 5,277,731 | 1/1994 | Krimsky et al. | 242/554.2 X |

*Primary Examiner*—James J. Engel
*Attorney, Agent, or Firm*—Arthur G. Yeager

[57] ABSTRACT

An elongate transfer tape includes a water-resistant removable top and bottom liner with two adhesive strips, one water soluble, the other water resistant, side-by-side in a plane between the liners. Above the water resistant adhesive is a water absorbent pad that when forced against paper will weaken the paper by the forced expulsion of water from the pad. The paper will attach to the tape and be drawn to a collecting spool to which the tape is attached. The paper will break along its weakened portion. The pad is constructed to hold water against the centrifugal forces that derive from the rotating collecting spool to which it is attached via the water resistant adhesive.

20 Claims, 2 Drawing Sheets

TRANSFER TAPE AND METHOD FOR CUTTING AND SPOOLING A WEB OF PAPER

BACKGROUND OF THE INVENTION

1. Field of the Invention

The present invention relates to apparatus for cutting and spooling a traveling web or sheet of paper in the paper making industry and particularly to cutting a web and transferring it to a empty spool.

2. Prior Art

It is common practice in the paper industry to wind a continuous sheet or web of paper onto a rotating spool and then to cut the sheet and begin winding the paper onto another spool. Modern technology requires the cutting and spooling to be done in the shortest possible time that is reliable, economical, and safe for the reason that paper-making technology provides a continuous sheet of paper. An example of one technique used for cutting and spooling is described in applicants' U.S. Pat. No. 4,659,029. An improved technique specifically adapted for use in tissue ground-wood paper and the like is disclosed herein.

SUMMARY OF THE INVENTION

In one aspect of the present invention, there is provided a transfer tape for severing a traveling web of paper and transferring the web of paper to an empty spool including an elongate planar adhesive member having an outer surface bindable to a traveling web of paper and an inner surface bindable to an empty spool. The adhesive member extends substantially along a length of a spool upon which a web of paper is to be transferred and wound, and an elongate water absorbent weakening means is carried by the outer surface of the adhesive member for absorbing water and weakening a web of paper as an empty spool carrying the transfer tape rotatably engages a paper web. The weakening means preferably includes a water resistant adhesive. Also, there is included a releasable liner overlying at least one of the inner and outer surfaces.

In other aspects of the invention the elongate adhesive member may include two strips of adhesive material, a first strip having a first adhesive material soluble in water and adapted to engage a web of paper and a second strip having a second adhesive material that is water resistant. The weakening means includes a narrow strip member mounted on an outer surface of the second strip, the second adhesive material having an inner surface bonded to an outer surface of the first strip along a leading edge thereof. The weakening means includes a pad of water-absorbent compressible material of substantially rectangular cross-sectional shape. Alternatively, the weakening means includes a plurality of elements, each element being formed of water-absorbent compressible material. The weakening means may also include a generally elongate somewhat compressible rib member and an elongate pad member overlying the rib member to substantially enclose the rib member between the pad member and the inner surface to affix the rib member and the pad member thereto.

In another aspect of the invention, the weakening means includes a pad member, the adhesive member including a paper layer having opposed elongated edges and inner and outer surfaces and narrow strip of water insoluble adhesive attached adjacent and along one said edge portion of the paper layer on its said outer surface, the adhesive member having water soluble adhesive carried by the inner surface of the paper layer and the outer surface of the paper layer.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
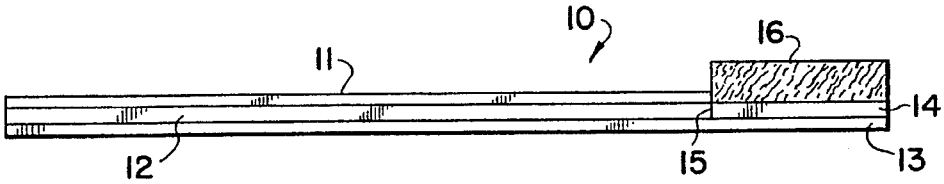
FIG. 1 is side diagrammatic view of the transfer tape in accord with the present invention.
Figure 2:
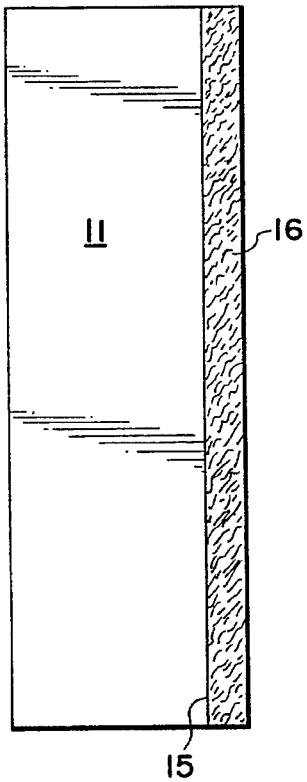
FIG. 2 is a top plan view of a length of the tape of FIG. 1.

With reference now to the drawings, a side diagrammatic view of one embodiment of the transfer tape in accord with the present invention is depicted at numeral 10 in FIG. 1. An upper, outer liner 11 is preferably a thin sheet of water-resistant releasable material such as silicone and is used to cover a first planar strip or sheet 12 of an adhesive member formed of a water soluble adhesive material that will not bind to liner 11. A lower, inner liner 13 is also a thin sheet of water-resistant releasable material. The adhesive member also includes a second strip 14 of water-resistant adhesive material that may extends in the same plane as first strip 12 and may be joined thereto along line 15 (FIG. 2). Alternatively, strip 12 will extend under strip 14. A pad 16 of water absorbent material is placed over and mounts to second strip 14, which functions as a pad-binding layer.

Pad 16 has a generally rectangular cross-sectional shape and is preferably made of a material such as the fibrous pulp-like material found in blotter paper and the like that will hold water when wet. Pad 16 is designed to hold water even under substantial centrifugal force for reasons that will be discussed hereinbelow.

Figure 3:
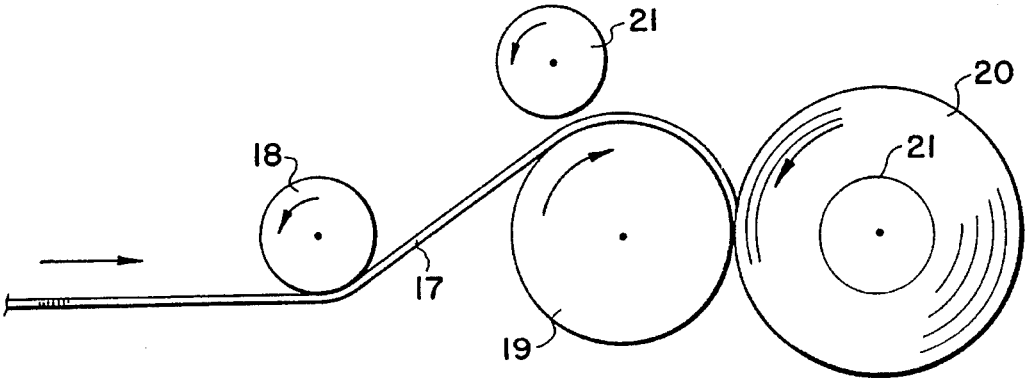
FIG. 3 is a side diagrammatic view of rollers and takeup spools in a typical paper-winding technology.
Figure 5:
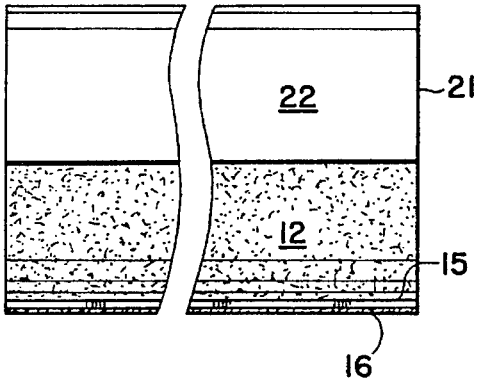
FIG. 5 is a front view of the spool and tape of FIG. 4.
Figure 4:
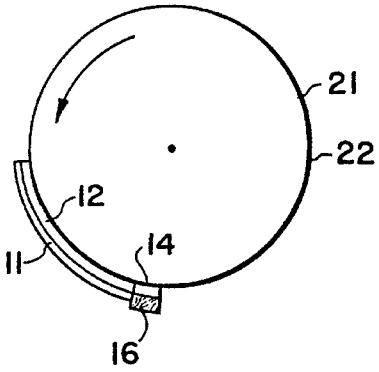
FIG. 4 is a side view of a takeup spool with the transfer tape in accord with the present invention attached thereto.

FIGS. 3–5 illustrate the use of the tape 10 in transferring a paper-rolling process from one spool to another. Paper 17 is fed from the paper making process onto a first and second roller 18 and 19 respectively. A first spool 20 is used to load the paper 17 thereon. When spool 20 is fully loaded, the transfer tape 10, shown enlarged for clarity, is placed on a second spool 21 as illustrated in FIGS. 4–5. First, inner liner 13 is removed and the tape is pressed onto the surface 22 of the spool 21 via spool-binding adhesive strips 12 and 14.

Next, the outer liner 11 is removed thus exposing the outer surface of water-soluble adhesive 12. Third, both strip 12 and the pad 16 are sprayed with water, which is absorbed. With the tape 10 attached, spool 21, rotating at the same speed as roller 19, is brought into contact with roller 19. The paper 17 is squeezed by the contact pressure and the water absorbed by pad 16 will be forced outwardly into paper 17 thus quickly weakening it substantially. The paper 17, which has adhered to the outer surface of adhesive 12, will break along a line around and above line 15 due to the change in direction of travel of the paper onto spool 21. The paper 17 will then be taken up by spool 21 which will then be moved into the proper secondary position for continued winding operation. Full spool 20 is moved away.

Figure 6:
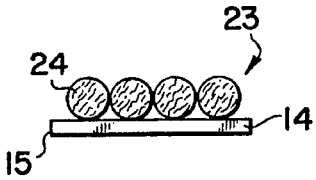
FIG. 6 and 7 are partial diagrammatic views of two alternative embodiments of the pad element of the tape of FIG. 1.
Figure 7:
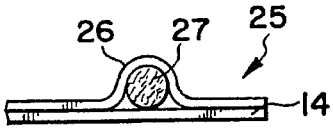

FIG. 6 illustrates an alternative embodiment of pad 16. A plurality of cords 24 to form a pad 23. The remainder of the tape is as before. Cords 24 may be made of paper or cotton to be sufficiently firm but also water-absorbent. FIG. 7 illustrates an alternative embodiment 25 of pad 16 which uses a water-absorbent material as before for the housing or cover 26 and a cylindrical rib member formed of a single cord 27 which may be of hemp or other material such as paper yarn that is even more firm than cords 24. Moreover, cord 27 need not be water-absorbent if sufficient water to weaken heavier paper is obtainable from cover 26. In most cases the cord will be water absorbent but will maintain its physical integrity at the same time. The remaining structure of the tape is as before. These embodiments are used to make an indentation into the paper to expedite the severing thereof.

As can be seen from the three embodiments, pads 16, 23 and 25 provide "a cutting member" for use with paper of various strength. The cords will provide an indentation into the water-weakened paper thus ensuring a quick break of the paper.

The above description employs the tape 10 placed on the spool 21 transverse the direction of movement of the paper 17 (FIG. 5). It is to be understood that other arrangements may be used such as diagonal or helical as may be appropriate in a particular application.

Figure 8:
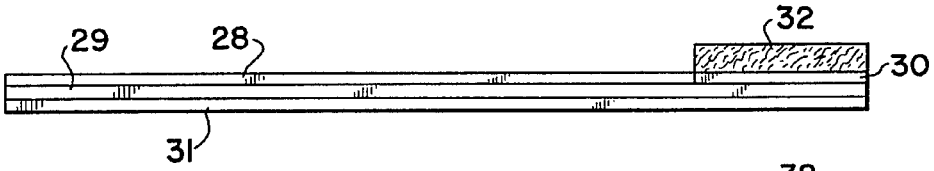
FIG. 8–11 are diagrammatic views of four alternative embodiments of the tape layering in accord with the present invention.

FIGS. 8–11 disclose alternative embodiments of the tape layering employed in the present invention. FIG. 8 illustrates an embodiment employing a water-resistant gum adhesive layer 28 on top of a layer of kraft paper 29. A non-water soluble gum adhesive or pressure-sensitive adhesive layer 30 is used for pad-binding and underlies pad 32 which is similar to pad 16 (FIG. 1). The lower layer 31 is gum adhesive and functions as the spool-binding layer.

Figure 9:
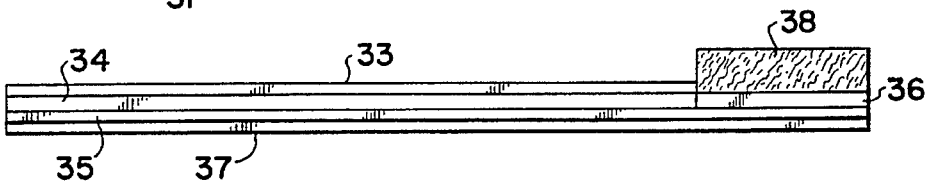

FIG. 9 illustrates an upper silicone liner 33 over a water-soluble pressure-sensitive adhesive layer 34 over kraft paper 35 over gum adhesive spool-binding layer 37. Pad binding layer 36 is either gum adhesive or pressure-sensitive adhesive which is water-resistant.

Figure 10:
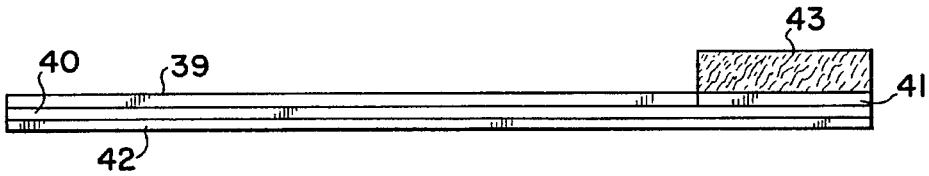

FIG. 10 illustrates a pressure-sensitive water soluble adhesive layer 40 with silicone liners 39, 42 as in FIG. 1 with a pressure-sensitive water resistant pad-binding and spool-binding layer 41. Adhesive 40 will also bind to the spool.

Figure 11:
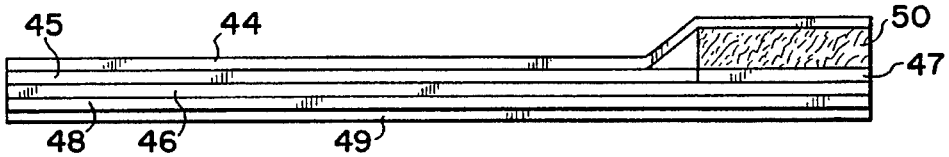

FIG. 11 illustrates an alternative embodiment employing an upper silicone liner 44 that covers pad 50 and overlies a water-soluble pressure-sensitive layer 45 over kraft paper 46 over a layer of pressure-sensitive adhesive 48 (soluble or non-soluble) over silicone liner 49. Spool binding layer is layer 48, the pad-binder is a non-soluble or water resistant adhesive layer 47.

Pads 32, 38, 43, and 50 are illustrated as being substantially identical to pad 16. It is to be understood that the alternative pads 23 and 25 may be used in any configuration of layering as appropriate in a particular application.

Figure 12:
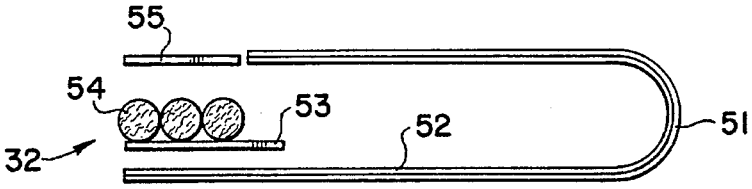
FIG. 12 is a transfer tape in accord with the present invention illustrating the physical construction of one embodiment thereof in diagrammatic form.

FIG. 12 illustrates an embodiment of the tape similar to FIG. 8 but which illustrates an actual construction of the transfer tape. Gum adhesive layer 51 is placed on one side of ordinary kraft paper 52 which is folded to place the adhesive outwardly. Pad-binding adhesive 53 could be a pressure sensitive and water resistant adhesive. Cords 54 are used for the pad 32. Optional removable water-absorbent covering material 55 may be of any appropriate material and is attached to cords 54 by appropriate means. FIG. 12 also illustrates that pad-binding material 53 may extend laterally as far as needed beyond the width of the pad 32. Similar construction techniques may be employed in the other illustrated embodiments as appropriate in the circumstances.

Figure 13:
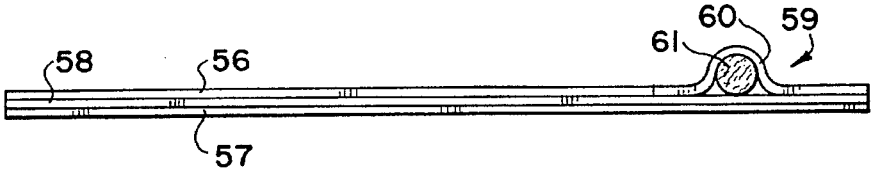
FIG. 13 is another embodiment of the transfer tape.

FIG. 13 is the preferred embodiment and illustrates the use of a single adhesive member for binding to a spool and to the pad 59 (as in FIG. 7) which includes cover 60 and cord 61. Liners 56 and 57 are as before.

The principal requirements for the adhesive material used are (1) the outer surface of the adhesive must be able to bind to wet or dry paper; (2) the inner surface of the adhesive must be able to bind to the surface of a spool; and (3) the pad binding adhesive should be water resistant. The tape 10 is normally supplied as a roll and the number and type of liners used depend upon the adhesives used and the need to prevent dust and water from adhering to the tape.

The pads are used as a weakening means to provide for the severing of the web of paper during transfer of the paper to an empty takeup spool. The pad used in a particular application depends on the type of paper that is to be cut.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. Transfer tape for severing a traveling web of paper and transferring it to an empty spool comprising an elongate planar adhesive member having an outer surface bindable to a traveling web of paper and an inner surface bindable to an empty spool, said adhesive member extending substantially along a length of a spool upon which a web of paper is to be transferred and wound, and an elongate water-absorbent weakening means carried by said outer surface of said adhesive member for absorbing water and engaging a web of paper as an empty spool carrying said transfer tape rotatably engages a paper web, said weakening means carrying water so that said weakening means weakens a paper web upon engagement therewith.

2. The tape as defined in claim 1 wherein said weakening means includes a water soluble adhesive.

3. The tape as defined in claim 2 further including a releasable liner overlying at least one of said inner and outer surfaces.

4. The tape as defined in claim 2 further including a releasable liner overlying said inner surface.

5. The tape as defined in claim 1 further including a first liner of releasable material substantially covering said outer surface and a second liner of releasable material substantially covering said inner surface.

6. The tape as defined in claim 1 wherein said elongate adhesive member includes two strips of adhesive material, a first strip having a first adhesive material soluble in water and adapted to engage a web of paper and a second strip having a second adhesive material resistant to water.

7. The tape as defined in claim 6 wherein said weakening means includes a narrow strip member mounted on an outer surface of said second strip, said second adhesive material having an inner surface bonded to an outer surface of said first strip along a leading edge thereof.

8. The tape as defined in claim 6 wherein said first liner substantially covers said first strip.

9. The tape as defined in claim 1 wherein said weakening means includes a pad of water-absorbent compressible material.

10. The tape as defined in claim 1 wherein said weakening means includes a pad having a substantially rectangular cross-sectional shape.

11. The tape as defined in claim 1 wherein said weakening means includes a plurality of elements, each said element being formed of water-absorbent compressible material.

12. The tape as defined in claim 1 wherein said weakening means includes a generally elongate partially compressible rib member and an elongate pad member overlying said rib member to substantially enclose said rib member between said pad member and said inner surface to affix said rib member and said pad member thereto.

13. The tape as defined in claim 12 wherein said pad member is formed of water-absorbent material.

14. The tape as defined in claim 12 wherein said rib member is formed of water-absorbent material.

15. The tape as defined in claim 12 wherein said pad member is formed of compressible material.

16. The tape as defined in claim 1 wherein said adhesive member includes an intermediate layer of paper carrying said outer and inner surfaces.

17. The tape as defined in claim 1 wherein said weakening means includes a pad member, said adhesive member including a paper layer having opposed elongated edges and inner and outer surfaces and a strip of water insoluble adhesive attached adjacent and along one said edge portion of said paper layer, on its said outer surface, said adhesive member having water soluble adhesive carried by said inner surface of said paper layer and said outer surface of said paper layer.

18. An improved method for severing a traveling web of paper being wound on a spool and transferring the web of paper after severing to an empty spool, the method including an elongate tape having opposed side respectively attachable to an empty spool and attachable to a web of paper for winding the severed web of paper onto the empty spool, wherein the improvement comprises the steps of:

A. applying a first adhesive to a portion of the surface of one side of the tape that is bindable to the surface of an empty spool;

B. applying a second adhesive to a portion of the surface of the other side of the tape that is bindable to the web of paper;

C. attaching a width of water-absorbent compressible element onto the other side of the tape and adjacent an edge thereof;

D. attaching the tape to the spool with the first adhesive;

E. applying water to the element attached in step C;

F. positioning the empty spool to place the element and the other side of the tape into contact with the traveling web of paper to compress the element for weakening the paper along a portion thereof in contact with the element by expelling water absorbed by the element in step E into the paper and to adhere the paper to the second adhesive;

G. severing the traveling web of paper along the weakened portion of the paper; and H. winding the severed web of paper onto the empty spool.

19. A method for severing a traveling web of paper being wound on a spool and transferring the web of paper after severing to an empty spool comprising the steps of:

A. providing an elongate tape carrying a water-absorbent elongate portion and having opposed sides repectively attachable to an empty spool and attachable to a web of paper;

B. adhesively attaching one side of the tape to an empty spool with the elongate portion being disposed outwardly of the empty spool;

C. spraying the outer surface of the elongate portion with water so that the same is capable of weakening a traveling web of paper along its width thereof;

D. contacting the empty spool with the traveling web of paper so that water is expelled from the elongate portion into the web of paper to weaken same and to adhere the traveling web downstream from the weakened portion of the web of paper to the empty spool; and E. rotating the empty spool to change the direction of the traveling web of paper to cause severing thereof along the weakened portion.

20. The method of claim 19 wherein step A includes the step of:

F. utilizing an adhesive on the adhesive means that has increased adhesion to the web of paper when it becomes wet during the spraying of water in step B.

* * * * *